US010612204B2

(12) United States Patent
Terata et al.

(10) Patent No.: US 10,612,204 B2
(45) Date of Patent: Apr. 7, 2020

(54) SLUICE GATE

(71) Applicants: Hiroshi Terata, Yokohoma (JP); Hiroko Terata, Yokohama (JP)

(72) Inventors: Hiroshi Terata, Yokohoma (JP); Hiroko Terata, Yokohama (JP); Shoko Kukita, Tokyo (JP); Keiichi Terata, Yokohama (JP); Yoko Terata, Yokohama (JP)

( * ) Notice: Subject to any disclaimer, the term of this patent is extended or adjusted under 35 U.S.C. 154(b) by 0 days.

(21) Appl. No.: 16/327,125

(22) PCT Filed: Aug. 22, 2016

(86) PCT No.: PCT/JP2016/074323
§ 371 (c)(1),
(2) Date: Feb. 21, 2019

(87) PCT Pub. No.: WO2018/037437
PCT Pub. Date: Mar. 1, 2018

(65) Prior Publication Data

US 2019/0194894 A1 Jun. 27, 2019

(51) Int. Cl.
*E02B 7/28* (2006.01)
*E02B 7/26* (2006.01)

(52) U.S. Cl.
CPC . *E02B 7/28* (2013.01); *E02B 7/26* (2013.01)

(58) Field of Classification Search
CPC ..... E02B 7/54; E02B 7/28; E02B 7/30; E02B 7/50; E02B 7/26
See application file for complete search history.

(56) References Cited

U.S. PATENT DOCUMENTS 5,725,326 A * 3/1998 Van den Noort ..... E02B 3/104 405/104
2009/0220301 A1* 9/2009 Miyao ..... E02B 7/205 405/21

(Continued)

FOREIGN PATENT DOCUMENTS

JP 9-031936 A 2/1997
JP 2003-253715 A 9/2003

(Continued)

OTHER PUBLICATIONS

International Search Report for PCT/JP2016/074323 dated Nov. 8, 2016 [PCT/ISA/210].

*Primary Examiner* — Carib A Oquendo
(74) *Attorney, Agent, or Firm* — Sughrue Mion, PLLC; Richard C. Turner

(57) ABSTRACT

A tank arrangement, duplicate cross-sectional restrictions, side roller block, openable reaction roller, openable bottom seal, reaction axle, openable side seal, gate slot inserting steps and a stress reduction cross-sectional restriction are presented to implement an emerging movement type opening/closing gate equipped with advantageous torsion structure. The arrangement enables a gate body to be operated in submerged-body state, the cross-sectional restrictions can correspond to both high tide pressure and tide flow pressure which are different in qualities, the side roller block, the openable reaction roller and the openable bottom seal resolve spatial interference problems in gate operation, compact reaction axles which endure big load enables cross-sectional restriction points at a narrow gap in a storage space, the openable side seal and the gate slot inserting steps prevent side seal rubber from damage and the stress reduction cross-sectional restriction can cut high tide pressure torsion moment by more than 50%.

4 Claims, 15 Drawing Sheets

(56) References Cited

U.S. PATENT DOCUMENTS

| | | | | |
|---|---|---|---|---|
| 2011/0110722 | A1* | 5/2011 | van den Noort | E02B 3/104 405/87 |
| 2011/0268506 | A1* | 11/2011 | Thornbury | E02B 3/104 405/118 |
| 2015/0117952 | A1* | 4/2015 | Gujer | E02B 3/104 405/96 |
| 2015/0218767 | A1* | 8/2015 | Terata | E02B 7/38 405/99 |
| 2016/0244927 | A1* | 8/2016 | Adler | E02B 7/26 |
| 2017/0284047 | A1* | 10/2017 | Terata | E02B 7/38 |
| 2018/0258600 | A1* | 9/2018 | Terata | E02B 7/40 |

FOREIGN PATENT DOCUMENTS

| | | | |
|---|---|---|---|
| JP | 2008-133602 | A | 6/2008 |
| JP | 2009-091736 | A | 4/2009 |
| WO | 2014/037987 | A1 | 3/2014 |

* cited by examiner

Detail A (Partially closed)

Section (Completely closed)

FIG.4

| Item | | Data | Unit | Note |
|---|---|---|---|---|
| Gate dimension | Span | 450 | m | ○○ Port Design A (Super Large Tidal Gate) (excluding steel weight) |
| | Height | 23 | | |
| | Width | 12.5 | | |
| Hydraulic condition | Site depth | 16 | | |
| | Tide def. | 5 | | |
| | Free board | 2 | | |
| Steel weight (rough estimation) | Gate leaf | 18000 | tf | |
| | Embedded part | 1500 | | |
| | Machine | 500 | | |
| | Total | 20000 | | |
| Gravity center | Horizontal | 18.75 | m | From the gate center |
| | Vertical | 11 | | Gate height center |
| Operation condition | Tide flow velocity | 1.60 | m/sec | |
| | | 3.11 | kt | |

FIG.8

| Gate body state | Gravity(tf) | | Buoyancy(tf) | | | Gate operation(tf) | |
|---|---|---|---|---|---|---|---|
| | Gate weight | Descending tank | Gate body | Left balance tank | Right balance tank | Descending force | Rising force |
| Submerged body-descending | 10061 | 403 | 0 | 4163 | 6098 | 203 | |
| Submerged body-rising | 10061 | 0 | 0 | 4163 | 6098 | | 200 |
| Floating body state | 10061 | 0 | 10061 | 0 | 0 | 0 | |

(Descending)

FIG.12

<table>
<tr><th rowspan="3">Step number</th><th colspan="5">Openable type (Embodiment 3)</th><th colspan="5">Fixed type (Embodiment 1)</th></tr>
<tr><th rowspan="2">Work content</th><th colspan="4">Status of open/close</th><th rowspan="2">Work content</th><th colspan="4">Status of open/close</th></tr>
<tr><th>Side roller</th><th>Reaction roller</th><th>Bottom seal</th><th>Side seal</th><th>Side roller</th><th>Reaction roller</th><th>Bottom seal</th><th>Side seal</th></tr>
<tr><td>1</td><td>Insert side roller</td><td rowspan="2">open</td><td colspan="2" rowspan="2">open</td><td rowspan="4">open</td><td>Insert side roller</td><td rowspan="4">open</td><td colspan="2" rowspan="2">open</td><td rowspan="5">close</td></tr>
<tr><td>2</td><td>Descending</td><td>Descending 1</td></tr>
<tr><td>3</td><td>Close bottom seal</td><td colspan="2" rowspan="3">close</td><td>Close bottom seal</td><td colspan="2" rowspan="4">close</td></tr>
<tr><td>4</td><td>Close side roller</td><td rowspan="2">close</td><td>Descending 2</td></tr>
<tr><td>5</td><td>Close side seal</td><td>close</td><td>Close side roller</td><td>close</td></tr>
</table>

5
27
23

19
Port side
Sea side
5
Detail C
Detail D 25
26
5

B
B

A
A
5

SLUICE GATE

CROSS REFERENCE TO RELATED APPLICATIONS

This application is a National Stage of International Application No. PCT/JP2016/074323, filed on Aug. 22, 2016.

TECHNICAL FIELD

The present invention relates to a sluice gate installed in a sluice for water flow or ships. The gate accommodates high tide water, tsunami, high water (reverse flow from a main river to a tributary stream), ocean waves, flood wood flow etc.

BACKGROUND ART

A large scale gate provided against high tide water, tsunami etc. is well known.

A torsion type structure has various advantage and the advantage gets more remarkable as a support width of the structure becomes larger. In case of a super large gate of 400 m width class, for instance, the gate weight is less than ½~⅓ of other structure types. A low weight leads to a low construction cost (Patent Document 1).

Emerging type is a publicly known gate body opening and closure operation type. Although a gate body of this type used to be a bending type structure, application of a torsion type structure is made possible by this invention and a big amount of construction cost reduction will become a reality.

FIGS. 1A-1E illustrate emerging movement type of an openable storm surge gate. FIG. 1 represents a right half of the gate viewed from a port side. FIG. 1A is a plan of a gate body completely closed. FIG. 1D is a plan of a gate body completely opened. FIG. 1B is AA section of FIG. 1A. FIG. 1E is BB section of FIG. 1D. FIG. 1C is CC section of FIG. 1B. FIG. 1F is DD section of FIG. 1E.

Reference numeral 1 denotes a gate body completely closed) and 2 denotes a gate body completely opened. The sluice gate of FIGS. 1A-1E are in either state 1 or 2.

3 denotes a storage space of gate body 1 and 4 denotes a center line of the tidal gate.

Completely opened gate body 2 is stored in storable space 3. Gate body 2 rises in used time, and moves to a position of completely closed gate body 1.

PRIOR ART DOCUMENTS

Patent Documents

Patent Document 1: WO2014/037987

DISCLOSURE OF THE INVENTION

Problems to be Solved by the Invention

Although the torsion structure has an overwhelming advantage in cost, its application to a gate has been limited to a flap gate that is fixed on the foundation ground via axle type supports. This invention enables application of the torsion structure to the emerging movement type of an openable storm surge gate and makes the overwhelming advantage of torsion structure even higher. The application is also applicable to a super large tidal gate having a structure support span between 200 to 600 m and more.

This invention shows resolutions to the following problems, contributing to implementation of a emerging movement type tidal gate of the torsion structure.

Problem 1: Cross-sectional restriction corresponding to high tide pressure and tide flow pressure Problem 2: Gate body movement of floating body state and submerged body state Problem 3: Spatial interference between cross-sectional restriction block parts Problem 3.1: Interference of support brackets and reaction axles Problem 3.2: Interference of support brackets and a bottom seal rubber Problem 3.3: Interference of a sealing sill and reaction rollers Problem 4: Sliding in stem direction of a side seal rubber Problem 5: Increase of torsion moment Problem 1: Cross-Sectional Restriction Corresponding to High Tide Pressure and Tide Flow Pressure A torsion structure is characterized by a thin wall closed cross-section and a cross-sectional restriction. The cross-sectional restriction is a state of a gate body section restricted at a point whose restriction condition is parallel displacement restricted and rotational movement free. A storm barrier gate endures high tide pressure of hurricanes and is subject to tide flow pressure during its opening and closure operation. The restriction point is a reaction point of those loads. As quality of the loads is prominently different from each other, duplicate cross-sectional restrictions will be required with gate size growing. Difference of their loading conditions are as follows.

(1) Loading conditions of high tide pressure (a) The load magnitude is dominantly big compared to tide flow.

(b) The load works on the gate of completely closed condition.

(c) The load acts only from a sea side.

(d) A restriction point which supports a dominantly big magnitude of load is set at a narrow space.

(2) Loading conditions of tide flow pressure (e) The load magnitude is dominantly small compared to high tide.

(f) The load works on the gate at all gate positions during gate operation.

(g) The load acts not only from a sea side but also from a port side.

Problem 2: Gate Body Movement in Floating Body State and in Submerged Body State Existing emerging type gates are hoisted mechanically. In this case, a gate is only a heavy cargo and neither a floating body nor a submerged body. In case of a super large gate with a few hundreds meters width, gate operation by floating tanks will become necessary. Accordingly, there exist states of a floating body and a submerged body whose stability mechanisms are completely different. In the description from right now, definition of both states are simply recognized as follows. The case that float tank is 100% submerged is "a state of submerged body" and the case that float tank is totally or partially emerges from the water is "a state of floating body" where the float tank buoyancy equals the gate weight. Stability mechanism are completely different between both states. In the state of floating body, buoyancy and dead weight of a gate body are equal, but in the state of submerged body, a gate is getting higher or lower and it is difficult for the gate to keep a rest state.

Problem 3: Spatial Interference Between Cross-Sectional Restriction Block Parts

FIGS. 2A-2C illustrate a cross-sectional restriction block. The block includes mechanisms of cross-sectional restriction and bottom sealing. Section (Completely closed) shows a tidal gate, and a storage space and place of Detail A. FIG. 2A illustrates a gate body completely closed and FIG. 2B illustrates a gate body partially opened. There are a restriction metal (support bracket), a seal sill for a bottom seal rubber and a roller escape on a concrete wall. A restriction metal (reaction axle), a bottom seal rubber and a reaction roller set on a gate body partially opened rise with the gate body and the reaction axle will mate to the support bracket and the seal rubber will mount the seal sill, and supporting and water sealing of the gate bottom will finish up. The reaction roller works as a reaction point of the tide flow pressure acting on the gate body during its rising and will complete this role by resting on the roller escape when the gate is completely closed. Although no spatial interference will occur between the parts the cross-sectional restriction block composes during gate operation at working time, interferences will occur during gate body insert operation into a gate slot at maintenance time etc. In short, interference problems at the gate body insert operation are (3.1) support brackets and reaction axles, (3.2) support brackets and a bottom seal rubber and (3.3) reaction rollers and a seal sill. Each problem is explained in the following.

Problem 3.1: Interference of Support Brackets and Reaction Axles

As illustrated on FIGS. 2A-2C support brackets (restriction, metals on a concrete wall) and reaction axles (restriction metals on a gate body) will spatially interfere each other at construction of maintenance time, and gate descending and rising in a gate slot will be blocked.

Problem 3.2: Interference of Support Brackets and a Bottom Seal Rubber

As illustrated on FIGS. 2A-2C, support brackets (restriction metals on a concrete wall) and a bottom seal rubber (on a gate body) will spatially interfere each other at construction or maintenance time, and gate descending and rising in a gate slot will be blocked.

Problem 3.3: Interference of a Sealing Sill and Reaction Rollers

As illustrated on FIGS. 2A-2C, reaction rollers (on a gate body) and a seal sill (on a concrete wall) will spatially interfere each other at construction or maintenance time, and gate descending and rising in a gate slot will be blocked.

Problem 4: Sliding in Stem Direction of a Side Seal Rubber

FIG. 3 illustrates sliding direction of a P type side seal rubber on a sill. The P type rubber bolted on a gate body by a clamp bar comprises a bulb and a stem. The figure shows four sliding directions in bulb and stem directions. Sliding direction of the rubber during gate operation at working time is in bulb direction and it will be made without any trouble. Sliding in stem direction of the rubber will be necessary when the gate is inserted into or taken out from a gate slot during construction or maintenance period and the sliding direction with x mark on the figure will decrease the seal life time eminently since the bulb is pinched between the clamp bar and the sill.

Problem 5: Increase of Torsion Moment

In the case of gate operation by floating tanks, torsion moment composed of buoyancy working on a gate body and downward reaction force working on cross-sectional restriction points will arise and torsion moment working on the gate body will increase since the buoyancy made torsion moment works in a same direction as high tide pressure torsion moment.

Means of Solving the Problems

A tank arrangement, duplicate cross-sectional restrictions, a side roller block, an openable reaction roller, an openable bottom seal, a reaction axle, an openable side seal, gate slot inserting steps and a stress reduction cross-sectional restriction are presented to implement an emerging movement type opening/closing gate which is equipped with costly advantageous torsion structure. The tank arrangement enables a gate body in working condition be operated in submerged body state, the duplicate cross-sectional restrictions can correspond to both high tide pressure and tide flow pressure which are prominently different in their qualities, the side roller block, the openable reaction roller and the openable bottom seal resolve spatial interference problems in gate operation at construction or maintenance time, presentation of compact reaction axles which endures to an extremely big load enables cross-sectional restriction points be set at a narrow gap in a storage space, the openable side seal and the gate slot inserting steps prevent side seal rubber from being damaged and the stress reduction cross-sectional restriction can cut an amount of the high tide pressure torsion moment by much more than 50% through a help of gate buoyancy.

BRIEF DESCRIPTION OF DRAWINGS

FIG. 4 is an example of tidal sluice gate planning data for embodiments.

FIG. 8 illustrates opening/closure operation force of Embodiment 1.

FIG. 12 illustrates Embodiment 3. It shows gate slot inserting steps in a table style.

EMBODIMENTS OF THE INVENTION

FIG. 4 is an example of tidal sluice gate planning data. Concerning hydraulic conditions on FIG. 4, ordinary water height is given in the form of site depth and a tide difference at high tide water is given as 5 m. In short, the port side depth is 16 m and the sea side depth is 21 m at high tide. Tide level is always moving and the port side level at construction, maintenance, gate operation or high tide can not be constant. Nevertheless it is assumed because of a simplification that the port side sea level is constant and can be defined as a site depth since purpose of the planning data is a feasibility study. In this Description, the port side depth and the sea side depth at high tide are sometimes called as a site water level and a high tide level respectively. The steel weight in FIG. 4 is rough estimate excluding a ballast.

Embodiment 1

FIGS. 5A-5D, 6A-6D, 7A-7C, 8, and 9A-9I are an example based upon the data of FIG. 4 and illustrates an emerging movement type tidal sluice gate.

Figure 5A:
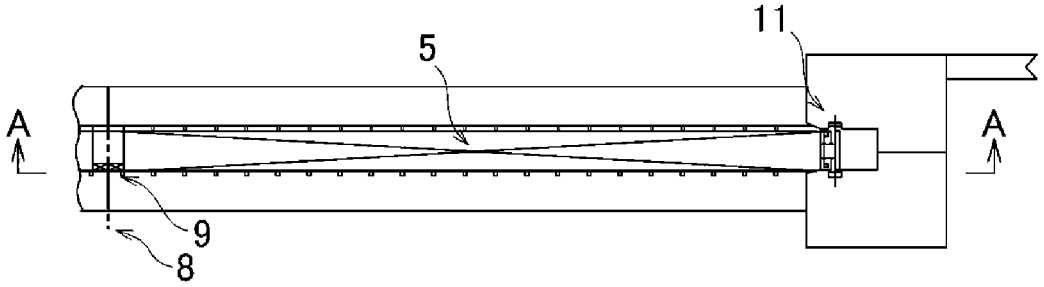
FIGS. 5A to 5D are total arrangements (plans and longitudinal sections) of Embodiment 1.
Figure 5B:
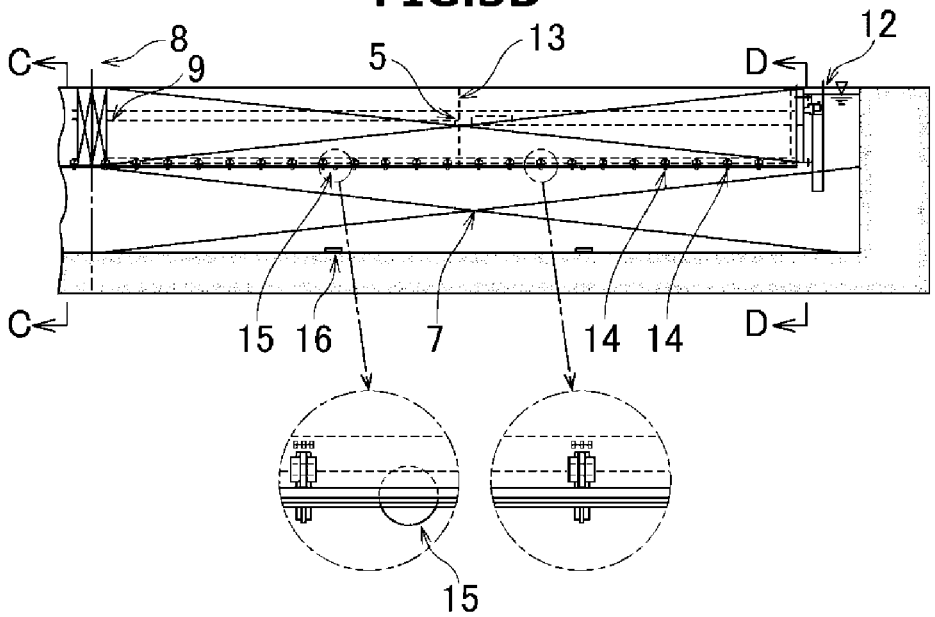
Figure 5C:
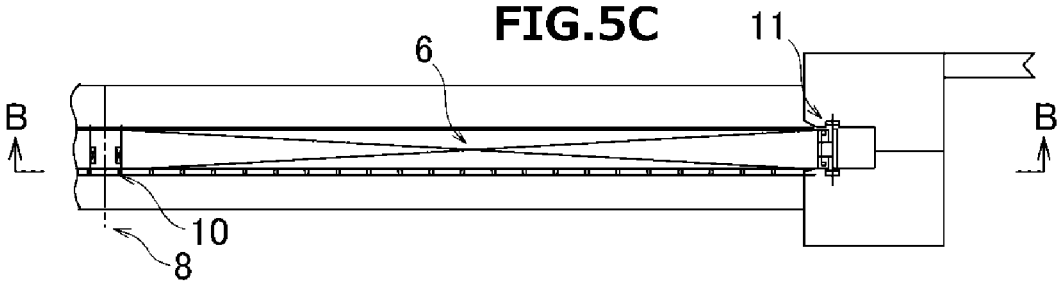
Figure 5D:
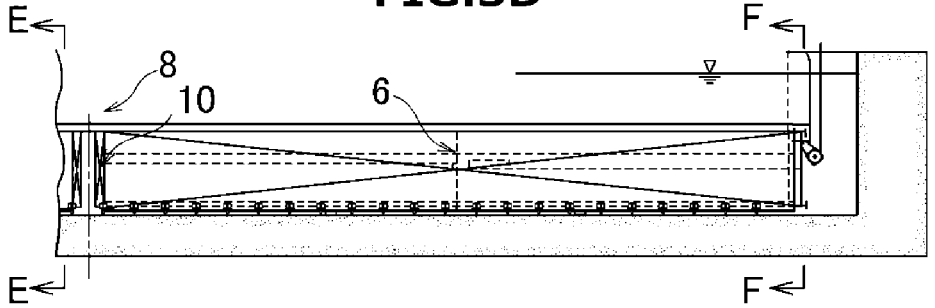

FIGS. 5A-5D illustrate the right half of tidal sluice gate viewed from a port side. FIG. 5A is a plan of a gate completely closed. FIG. 5C is a plan of a gate completely opened. FIG. 5B is AA section of FIG. 5A. FIG. 5D is BB section of FIG. 5C. A upper side on FIG. 5A and FIG. 5C is a sea side and a lower side on them is a port side.

5 denotes a gate body completely closed. 6 denotes a gate body completely opened. The sluice gate of FIGS. 5A-5D is in either state 5 or 6.

7 denotes a storage space of the gate body 5, 8 denotes a center line of the tidal sluice gate, 9 denotes an interval gate completely closed, 10 denotes an interval gate completely opened, 11 denotes a side roller block, 12 denotes a side roller guide, 13 denotes a watertight bulkhead, 14 denotes a cross-sectional restriction blocks, 15 denotes a bottom roller and 16 denotes a bottom roller mounting.

A cross section of the gate body 5 and 6 is a closed thin shell section.

Figure 6A:
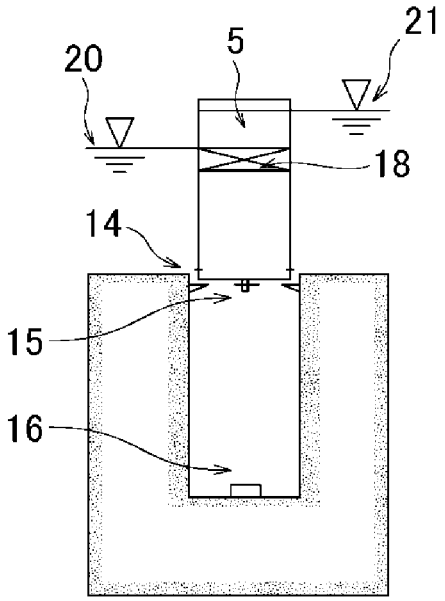
FIGS. 6A to 6D are total arrangements (cross sections) of Embodiment 1.
Figure 6B:
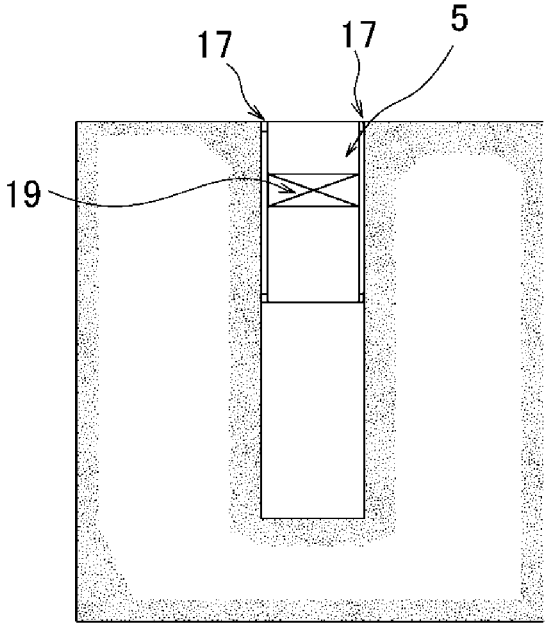
Figure 6C:
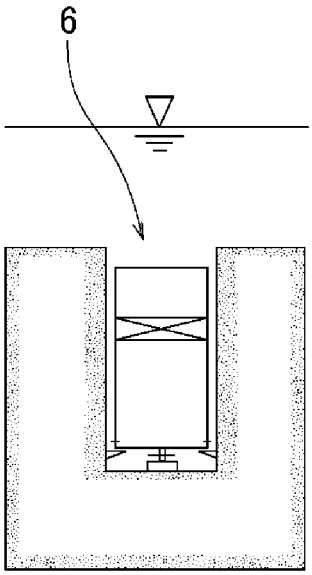
Figure 6D:
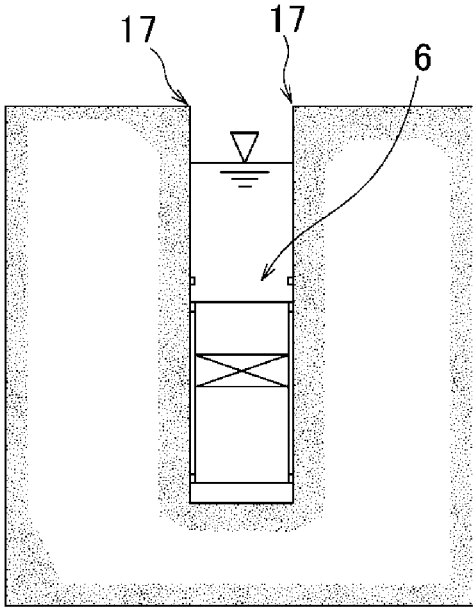

FIGS. 6A-6D are cross sections of the sluice gate shown on FIG. 5. FIG. 6A is CC section of FIG. 5B FIG. 6B is DD section of FIG. 5B FIG. 6C is LE section of FIG. 5D. FIG. 6D is FF section of FIG. 5D. A right side on FIG. 6A thru FIG. 6D is a sea side and a left side on them is a port side.

17 denotes coupling wedges, 18 denotes a left balance tank, 19 denotes a right balance tank, 20 denotes a site water level and 21 denotes a high tide level. Parts which are identical on FIGS. 5A-5D are given identical reference numbers on FIGS. 6A-6D.

Figures 7A, 7B, 7C:
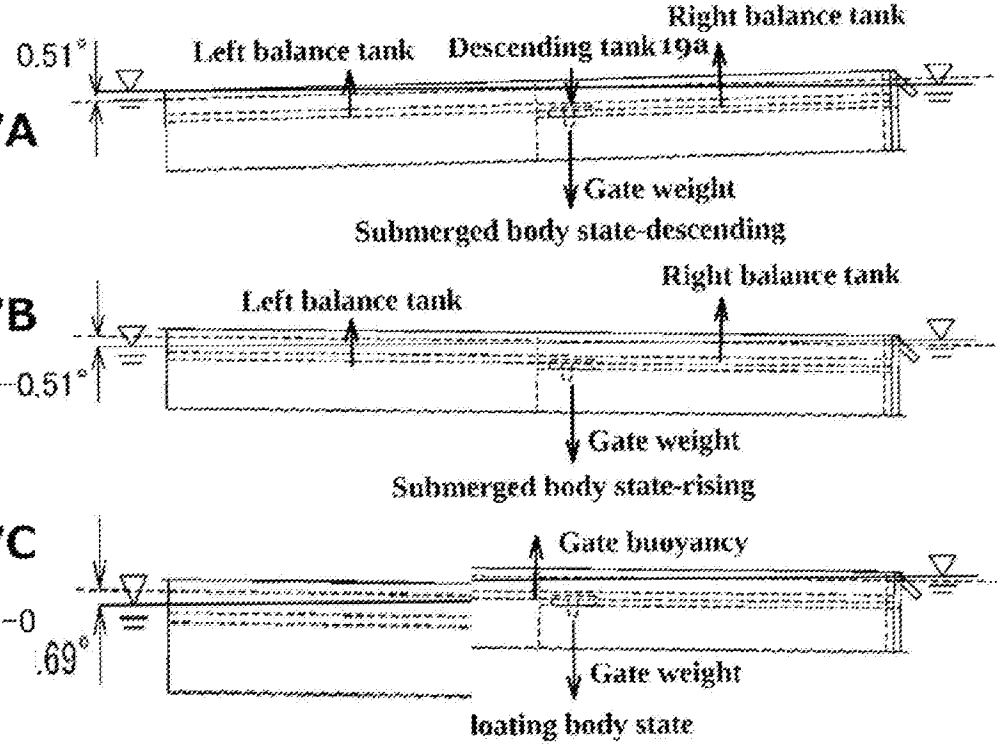
FIGS. 7A to 7C illustrate gate body inclinations and tank arrangements of Embodiment 1.

FIGS. 7A-7C illustrate gate body inclinations and buoyancy and gravity which tie to the inclination, and arrangements of tank 18, 19 and 19*a*

The gate body inclinations shown are in submerged body states of rising and descending cases and in floating body state. The inclination in a submerged body state is caused from roller frictions. The Inclination in floating body state is caused from a gap between a gate body gravity center and a buoyancy center, and a ballast is taken in the gate body to reduce the inclination. Roller friction is not considered in an inclination angle calculation since stability in floating body state is quite big (corresponding to previously mentioned "Problem 2: Gate body movement in floating body state and submerged body state". A working place and a direction of the forces which tie to the gate body inclination are shown by arrows on FIGS. 7A-7C).

The tank arrangement includes a left balance tank 18, a right balance tank 19 and a descending tank 19*a*, total buoyancy of the balance tanks 18 and 19 is just a bit bigger than the gate weight and their buoyancy center conforms to the gate body gravity center and their roof height conforms to the site water level (refer to the left balance tank 18, the right balance tank 19 and the site water level 20 on FIG. 6A and FIG. 6B). The descending tank 19*a* is located in the right balance tank 19, its center conforms to the gate gravity center and a buoyancy volume of the balance tanks 18 and 19 subtracted by the descending tank 19*a* is just a bit smaller than weight of the gate body 5. The left balance tank 18 and the right balance tank 19 are in a state of submerged body and gate operation at working condition is made by pouring/discharging water into or from the descending tank (corresponding to previously mentioned "Problem 2: Gate body movement in floating body state and submerged body state").

FIG. 8 illustrates descending force and rising force of opening/closure operation in submerged body state (descending and rising cases) and in floating body state. The gravity and the buoyancy in the figure correspond to the arrows on FIGS. 7A-7C. Opening/closure operation in floating body state is made by pouring/discharging water into or from a gate body.

Figure 9B:
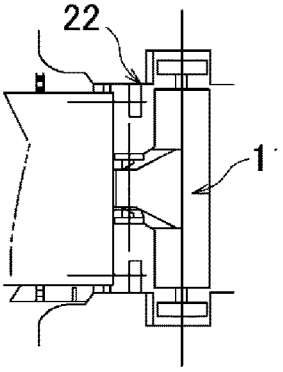
FIGS. 9A to 9I illustrate support and sealing mechanisms of Embodiment 1.
Figure 9A:
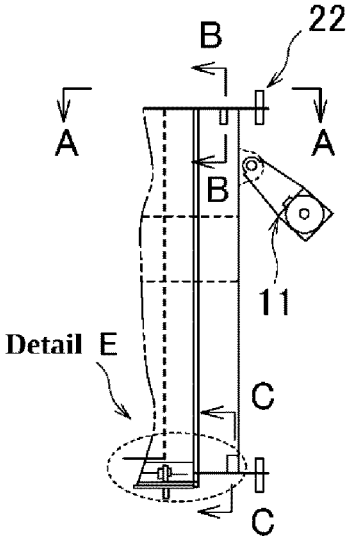
Figure 9C:
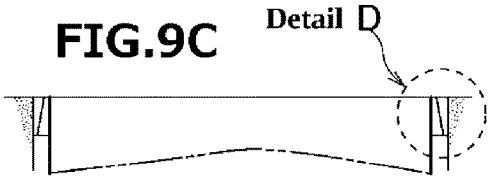
Figure 9D:
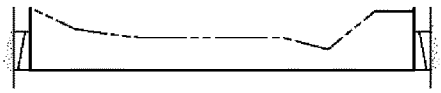
Figure 9E:
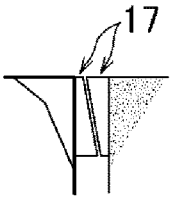
Figure 9F:
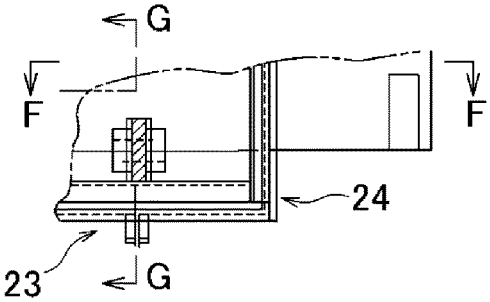
Figure 9G:
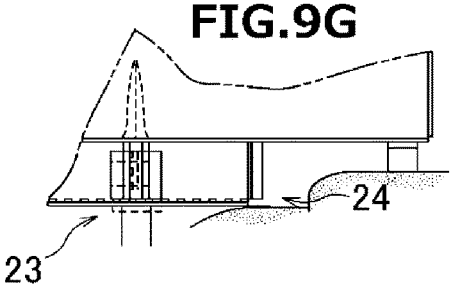
Figure 9H:
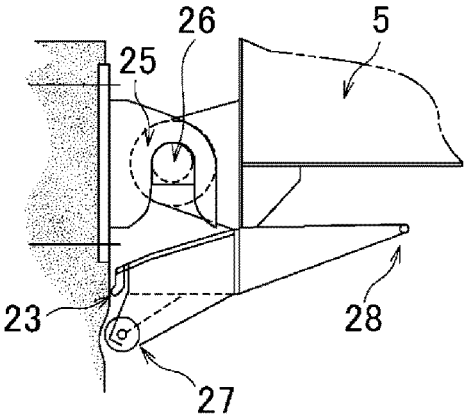
Figure 9I:
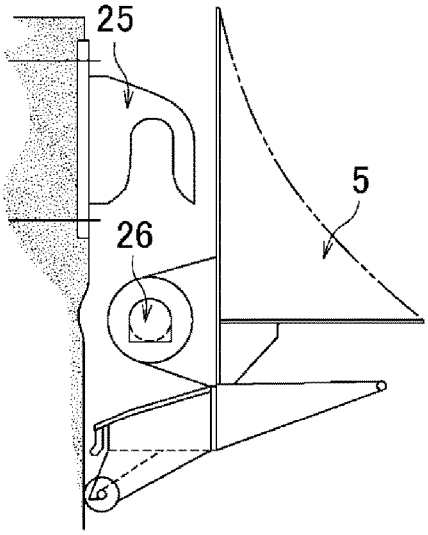

FIGS. 9A-9I illustrate support and sealing mechanisms of a gate body. FIG. 9A is a right end part detail of the completely closed gate body 5 shown on FIG. 5B FIG. 9B is AA section of FIG. 9A. FIG. 9C is BB section of FIG. 9A. FIG. 9D is CC section of FIG. 9A. FIG. 9E is Detail D of FIG. 9C FIG. 9F is Detail E of FIG. 9A. FIG. 9G is FF section of FIG. 9F. FIG. 9H is GG section of FIG. 9F and illustrates the cross-sectional restriction block 14. FIG. 9I illustrates a descending state of the completely closed gate body 5 of FIG. 9H.

22 denotes a main roller, 23 denotes a bottom seal rubber, 24 denotes a side seal rubber, 25 denotes a support bracket, 26 denotes a reaction axle, 27 denotes a reaction roller and 28 denotes a rotation axle of the bottom seal rubber 23 and the reaction roller 27. Parts which are identical on FIGS. 5A-5D or FIGS. 6A-6D are given identical reference numbers on FIGS. 9A-9I.

The cross-sectional restriction block 14 consists of the support bracket 25, the reaction axle 26, the bottom seal rubber 23 and the reaction roller 27.

High tide pressure working on the completely closed gate body 5 is supported by the support bracket 25 and the reaction axle 25 (a cross-sectional restriction point for high tide pressure). Torsional moment composed of the high tide pressure and its reaction force is carried to a right end of the gate body 5 through torsional rigidity and balances a coupling force working on the wedges 17. Tide flow pressure working on the gate body during opening/closure operation is supported by the reaction roller 27 (a cross-sectional restriction point for tide flow pressure). Torsional moment composed of the tide flow pressure and its reaction force is carried to a right end of the gate body 5 through torsional rigidity and balances a coupling force working on the main wheels 22 (corresponding to previously mentioned "Problem 1: Cross-sectional restriction corresponding to high tide pressure and tide flow pressure").

Figure 1A:
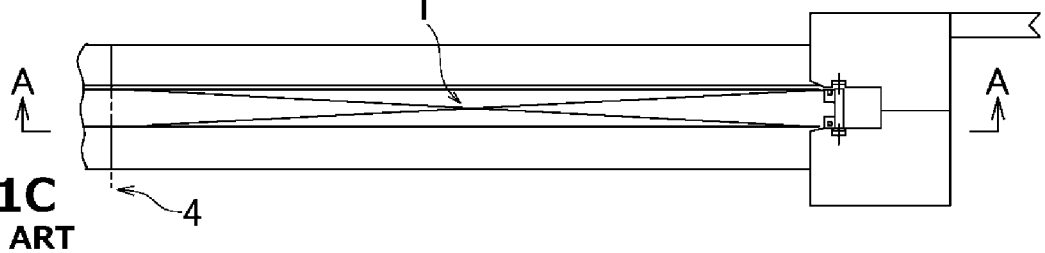
FIG.1A PRIOR ART
FIGS. 1A to 1F are explanatory drawings of an emerging movement type opening/closure tidal gate.
Figure 1C:
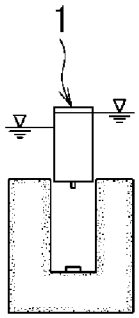
FIG.1C PRIOR ART
Figure 1B:
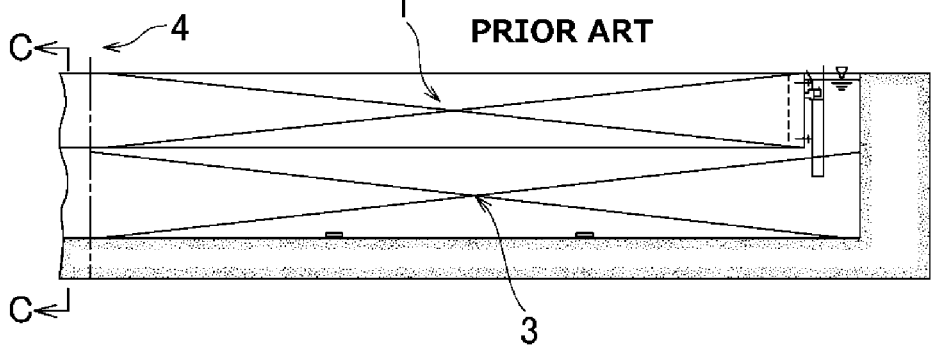
FIG.1B PRIOR ART
Figure 1D:
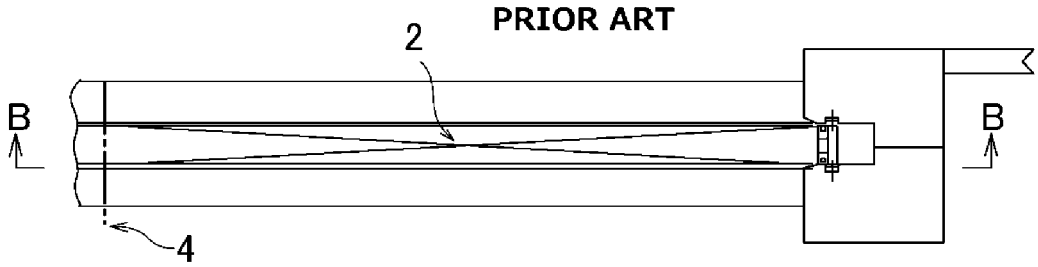
FIG.1D PRIOR ART
Figure 1F:
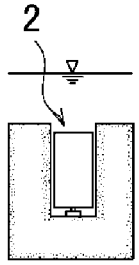
FIG.1F PRIOR ART
Figure 1E:
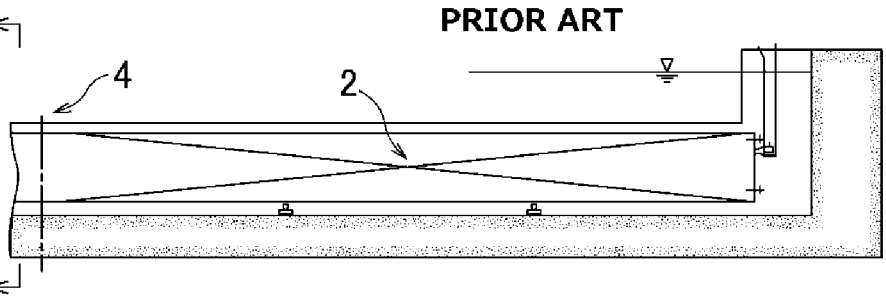
FIG.1E PRIOR ART
Figure 2A:
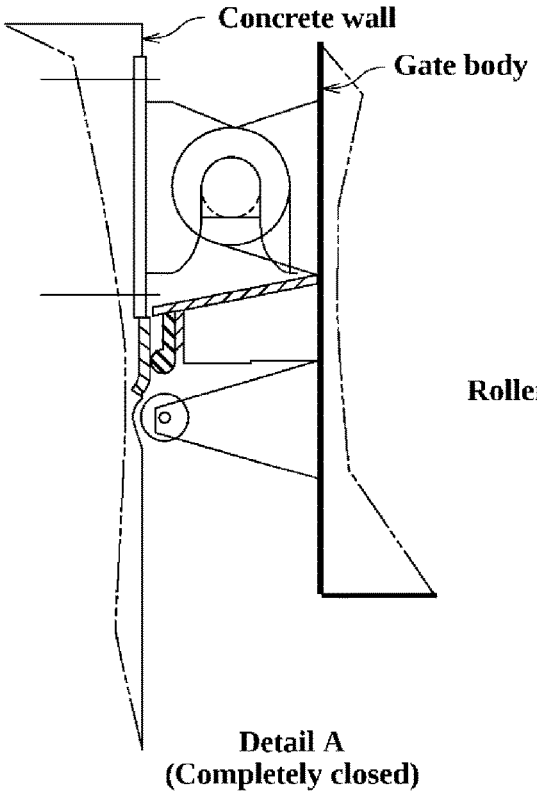
FIG.2A PRIOR ART
FIGS. 2A to 2C are examples of cross-sectional restriction block for torsion structure emerging type.
Figure 2B:
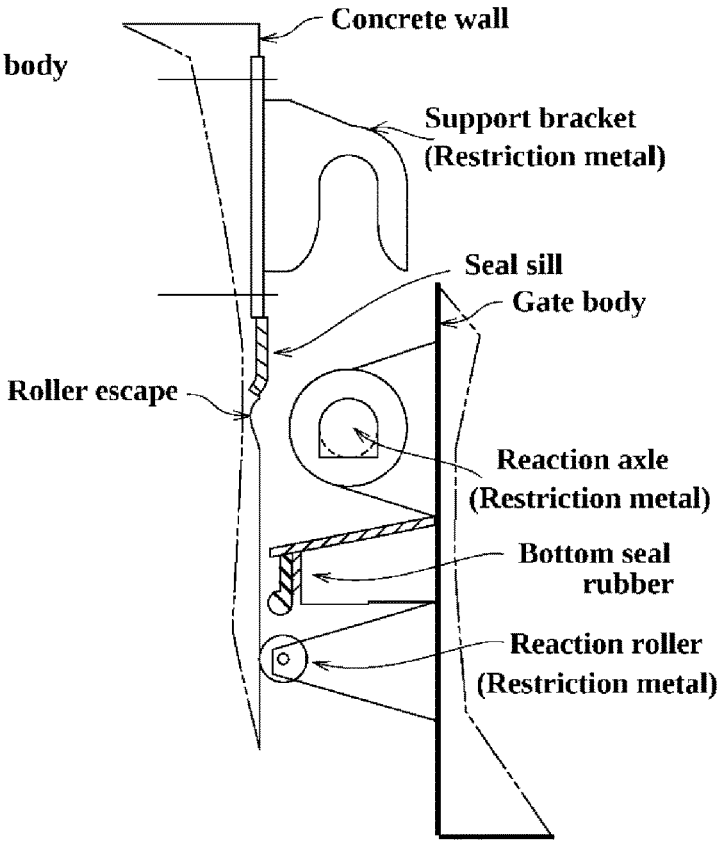
FIG.2B PRIOR ART
Figure 2C:
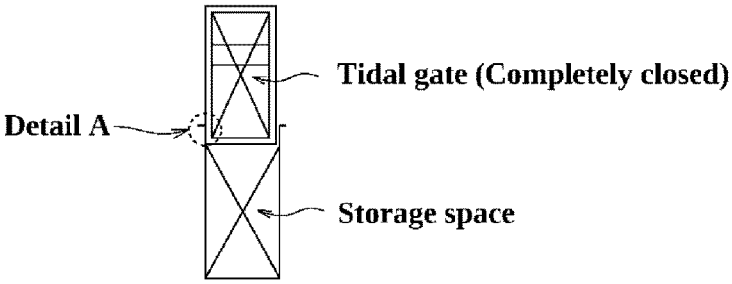
FIG.2C PRIOR ART

The side roller block 11 is joined to the gate body 5 by an axle and spatial interference between the support bracket 25 and the reaction axle 26 during gate operation in construction or maintenance period is evaded by a change of gate position in a gate slot through the block 11 rotation around the axle (corresponding to previously mentioned "Problem 3.1: Interference of support brackets and reaction axles"). The bottom seal rubber 23 and the reaction roller 27 are integral structure and an interval between a concrete wall and a gate body is opened by their rotation around the rotation axle 28 at construction or maintenance period. Spatial interference between the support bracket 25 and the bottom seal rubber 23 can be evaded by this interval openable procedure (corresponding to previously mentioned "Problem 3.2: Interference of support brackets and a bottom seal rubber"). And spatial interference between the reaction roller 27 and the seal sill shown on FIGS. 2A-2C can be evaded also (corresponding to previously mentioned "Problem 3.3: Interference of a sealing sill and reaction rollers"). Although rotation in a vertical plane around the rotation axle 28 of the bottom seal rubber 23 and the reaction roller 27 is presented here to solve their spatial interference problems through an interval openable procedure, the procedure can be also put into practice by rotation in a horizontal plane, parallel shift in a horizontal plane etc. Mechanism to realize these procedures can be a slide mechanic, link mechanic etc.

The side seal rubber 24 is fixed on the gate body 5 and has no rotation axle such as the rotation axle 28 of the bottom seal rubber 23. Evading of the X marked stem direction sliding shown on FIG. 3 becomes a reality in gate slot inserting steps of the gate body 5 for construction or maintenance work (will be explained again later).

Embodiment 2

FIGS. 10A-10G are an example based upon the data of FIG. 4 and illustrates details of the support bracket 25 and the reaction axle 26 of Embodiment 1.

Figure 10A:
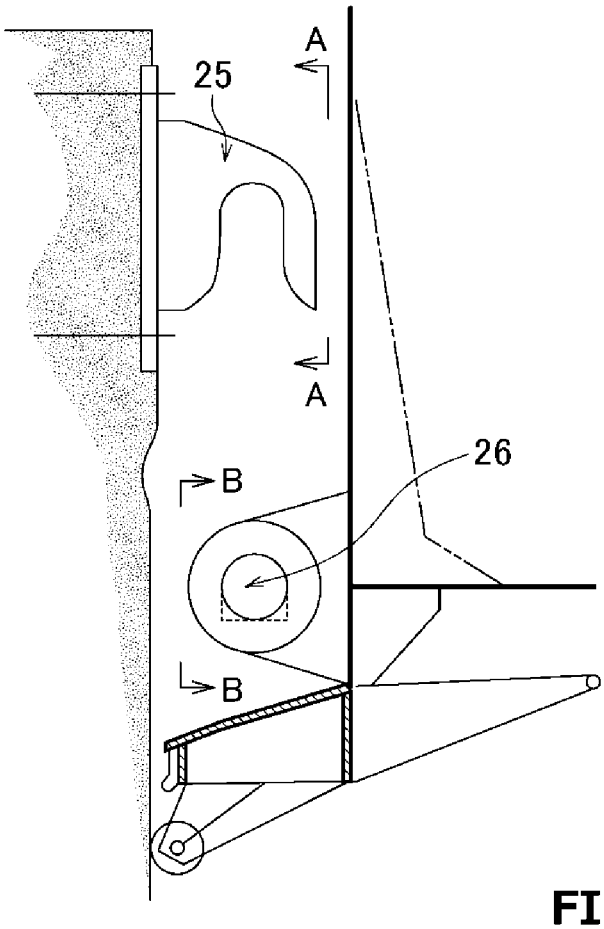
FIGS. 10A to 10G illustrate Embodiment 2. It is support bracket and reaction axle details of Embodiment 1.
Figure 10B:
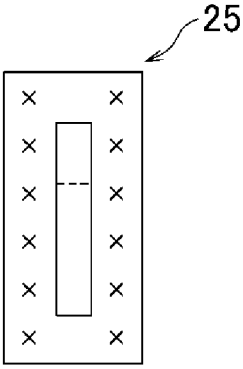
Figure 10C:
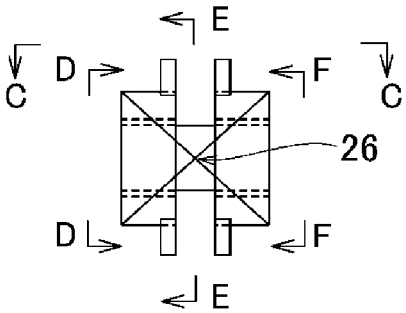
Figure 10D:
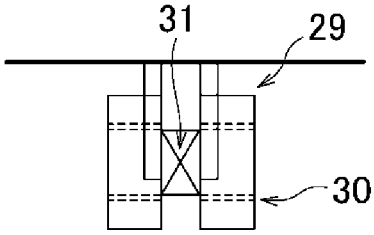
Figure 10E:
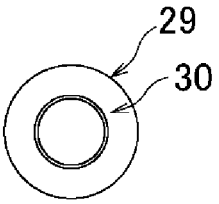
Figure 10F:
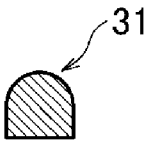
Figure 10G:
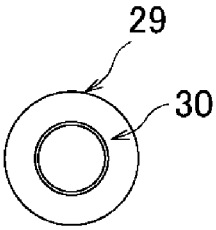

FIG. 10A is an enlarged view of FIG. 9I which is a side view of the cross-sectional restriction block 14. FIG. 10B is AA section of FIG. 10A and shows an elevation of the support bracket 25. FIG. 10C is BB section of FIG. 10A and shows an elevation of the reaction axle 26. FIG. 10D is CC section of FIG. 10C. FIG. 10E is DD section of FIG. 10C. FIG. 10F is EE section of FIG. 10C. FIG. 10G is FF section of FIG. 10C.

29 denotes hubs, 30 denotes oil-less bearings and 31 denotes an axle mating part of the reaction axle 26 where the support bracket 25 contacts the reaction axle 26. Parts which are identical on FIGS. 9A-9I are given identical reference numbers on FIGS. 10A-10G.

A set of the support bracket 25 and the reaction axle 26 is installed at a narrow interval between a gate body and a concrete wall. A load working on it is high tide pressure and extremely big which goes to scale at 50 times of tide flow pressure load (approximately 1000 tf). The axle mating part 31 of the reaction axle 26 is hog-backed and formed according to a bearing surface design and the hubs 29 and the oil-less bearings 30 which are arranged at both ends of the reaction axle 26 are formed according to a static load design so that a set of the support bracket 25 and the reaction axle 26 may be compact sized. A bearing surface of the reaction axles 26 slides by max. 3.8 mm due to high tide pressure. Since tidal level change is slower pace (per 6 hours or so), a static load design application to the oil-less bearing 30 is possible (corresponding to previously mentioned "(d) of (1) Loading conditions of high tide pressure of Problem 1: Cross-sectional restriction corresponding to high tide pressure and tide flow pressure").

Embodiment 3

Figure 13:
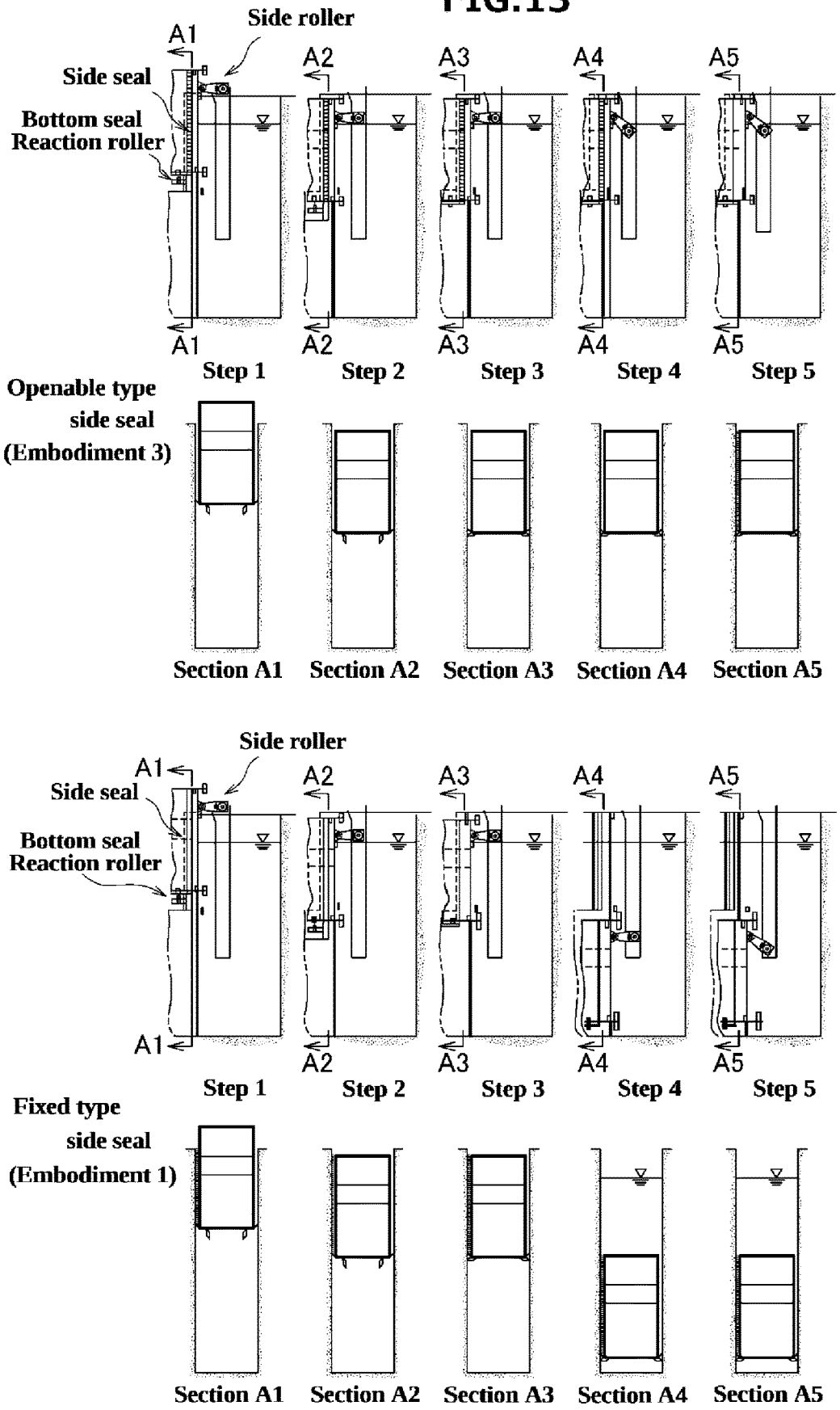
FIG. 13 illustrates Embodiment 3. It shows gate slot inserting steps in a drawing style.

FIGS. 11A-11H, 12, and 13 are an example based upon the data of FIG. 4. FIG. 12 and FIG. 13 illustrate gate body inserting steps of the openable type side seal and Embodiment 1 type side seal which is hereinafter called as fixed type side seal or fixed type.

Figure 11A:
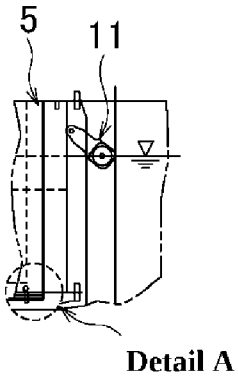
FIGS. 11A to 11H illustrate Embodiment 3. It shows a openable side seal detail.
Figure 11E:
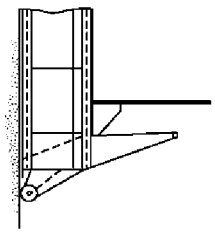
Figure 11C:
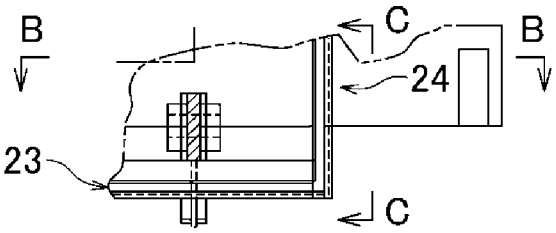
Figure 11D:
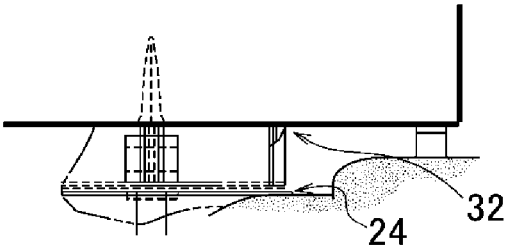
Figure 11G:
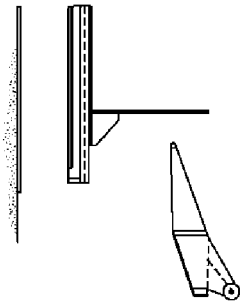
Figure 11B:
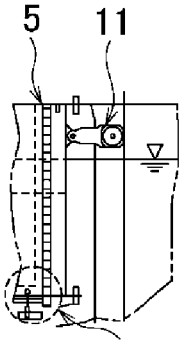
Figure 11F:
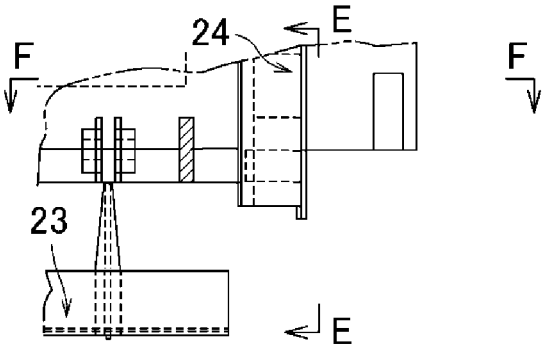
Figure 11H:
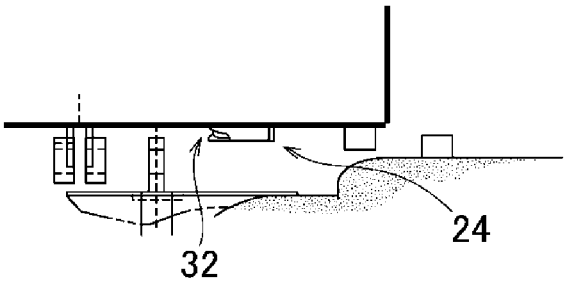

FIGS. 11A-11H illustrate details of the openable type side seal. FIG. 11A is details of a left end part of the completely closed gate body 5 shown on FIG. 5B. FIG. 11B is details of a left end part of the gate body 5 of FIG. 11A when the gate body 5 is inserted into a gate slot during construction or maintenance work, FIG. 11C is Detail A of FIG. 11A. FIG. 11D is BB section of FIG. 11C. FIG. 11E is CC section of FIG. 11C. FIG. 11F is Detail D of FIG. 11B. FIG. 11G is EE section of FIG. 11F. FIG. 11H is FF section of FIG. 11F.

32 is a rotation axle of the side seal rubber 24. Parts which are identical on FIGS. 9A-9I are given identical reference numbers on FIGS. 11A-11H.

Although a main subject FIGS. 11A-11H shows is a side seal rubber, a bottom seal rubber 23 is also shown since the bottom seal rubber 23 and the side seal rubber 24 spatially relate each other.

A difference of the fixed type and the openable type is a part a corner rubber belongs to (bottom rubber or side rubber) and existence or not existence of the rotation axle 32 of the side seal rubber 24, and there is no difference in gate body operation at working condition and a difference appears in a gate slot inserting steps at maintenance period.

FIG. 12 and FIG. 13 illustrate a gate slot inserting steps of the openable type (Embodiment 3) and the fixed type (Embodiment 1).

FIG. 12 illustrates work content and open or close status of a side roller, a reaction roller, a bottom seal rubber and a side seal rubber of each step in a tabular form.

FIG. 13 illustrates FIG. 12 schematically.

The work contents of both types are exactly same at step 1 thru 3 and a difference of a side seal handling appears at step 4 and 5.

Figure 3:
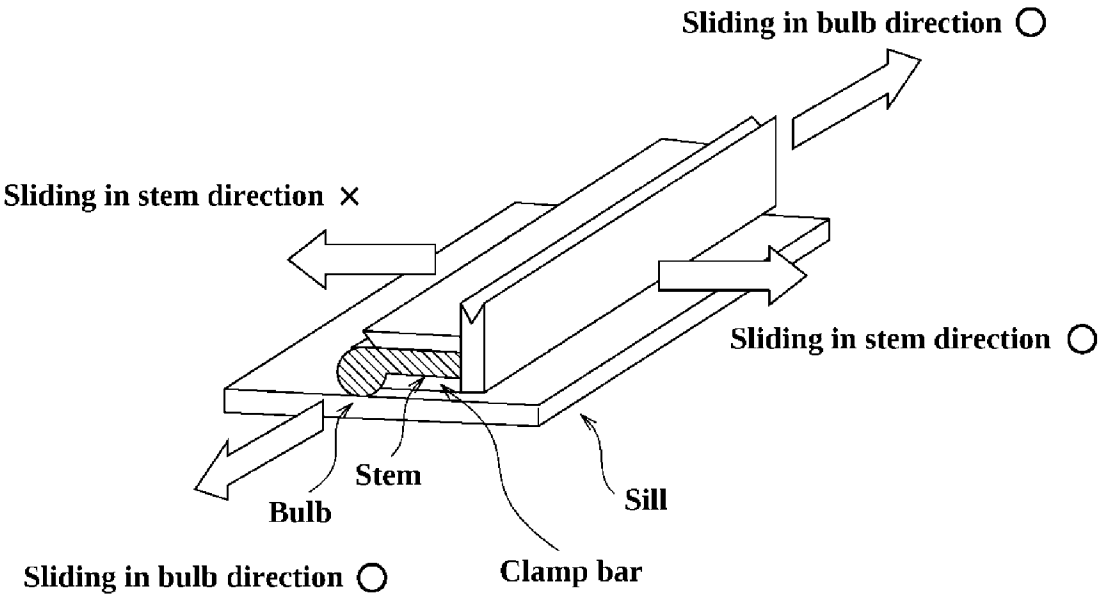
FIG.3 PRIOR ART
FIG. 3 is a explanatory drawing of sliding directions of a P-shape seal rubber on a seal sill.

In case of the openable type, the gate body 5 moves to its working position through a closure of the side roller at step 4 and a stem direction sliding which is shown by x on FIG. 3 is evaded through a closure of the side seal rubber at step 5 (corresponding to previously mentioned "Problem 4: Sliding in stem direction of a side seal rubber"). All steps of the openable type are carried out in floating body state and the gate slot inserting step completes without the gate body 5 moves to its completely opened position.

In case of the fixed type, the gate body 5 moves down to its completely opened position (=height of the gate body 6) at step 4, and then the gate body 5 moves to its working position through closure of the side roller at step 5. A stem direction sliding which is shown by x on FIG. 3 is evaded since a seal sill for a side seal rubber does not exists on a concrete wall at this gate position (corresponding to previously mentioned "Problem 4: Sliding in stem direction of a side seal rubber"). Although step 5 is made in submerged body state, the remove operation of the gate body 5 is carried out with a help of bottom rollers 15 (refer to FIGS. 5A-5D) without any difficulties (corresponding to previously mentioned "Problem 2: Gate body movement in floating body state and submerged body state").

Above steps are the case when a gate body is inserted into a gate slot and steps when a gate body is taken out is reverse to them.

Embodiment 4

FIGS. 14A-14E and FIG. 15 are an example based upon the data of FIG. 4 and illustrate a cross-sectional restriction point arrangement to cut torsion moment through the use of buoyancy and its result.

Figures 14A, 14B, 14C, 14D, 14E:
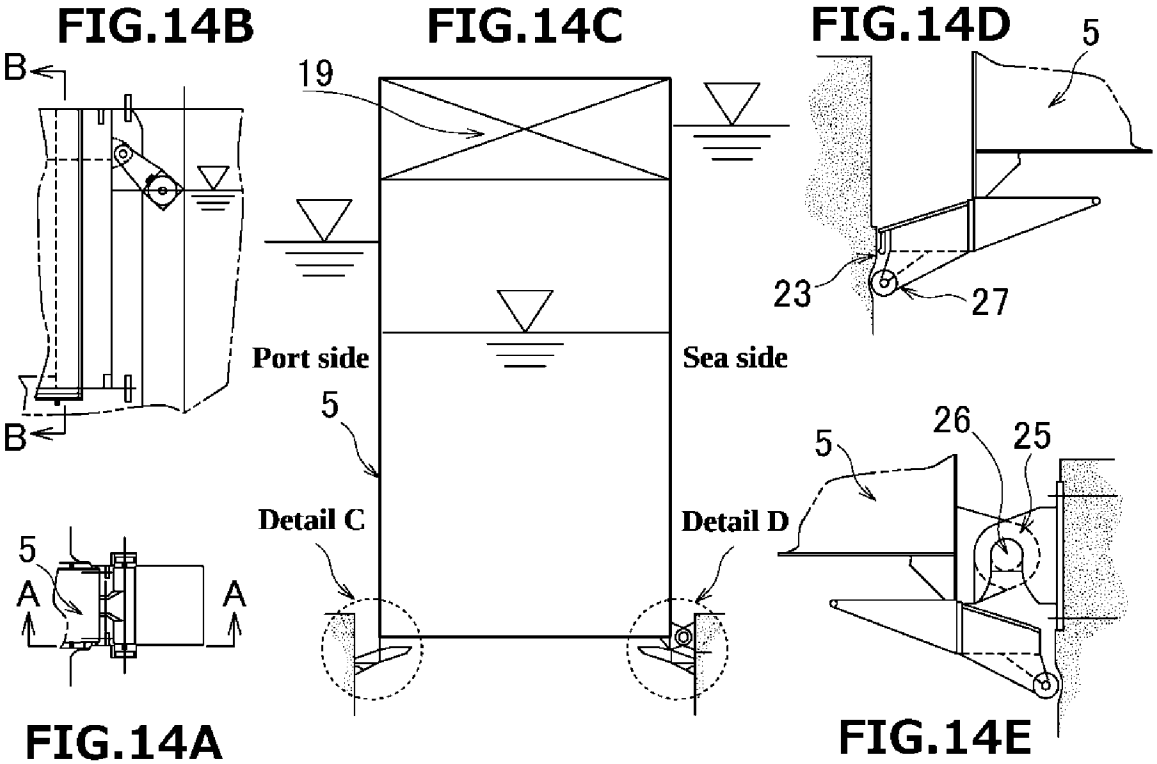
FIGS. 14A to 14E illustrate Embodiment 4. It shows stress reduction cross-sectional restriction arrangements.

FIGS. 14A-14E illustrate a cross-sectional restriction point arrangement. FIG. 14A is a plan of a right end part of the completely closed gate body 5. FIG. 14B is AA section of FIG. 14A. FIG. 14C is BB section of FIG. 14B FIG. 14D is Detail C of FIG. 14C. FIG. 14E is Detail D of FIG. 14C FIG. 14E illustrates cross-sectional restriction point.

Parts which are identical on FIGS. 5A-5D or FIGS. 9A-9I are given identical reference numbers on FIGS. 14A-14E.

Different points from Embodiment 1 are cross-sectional restriction points against high tide pressure (the support bracket 25 and the reaction axle 26) are arranged on a sea side and top of the left and right balance tanks, 18 and 19, conforms to gate body top. Arrangements of cross-sectional restriction points against tidal flow pressure (the reaction roller 27) and the bottom seal rubber 23 are as same as Embodiment 1.

Figure 15:
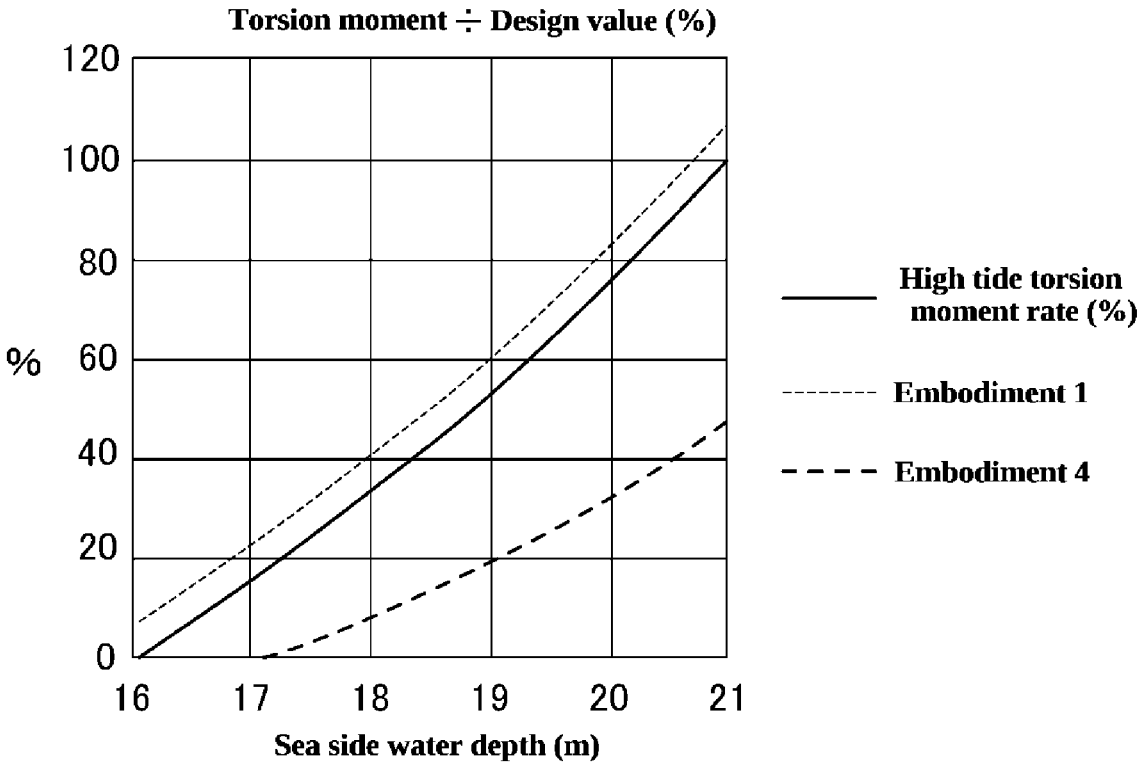
FIG. 15 illustrates Embodiment 4. It shows a result of FIG. 14.

FIG. 15 illustrates a result of cross-sectional restriction point arrangement alternative graphically. High tide torsion moment and torsion moments composed of high tide pressure and buoyancy in case of Embodiment 1 and Embodiment 4 are shown on a lateral axis of sea side water depth. The site water depth is 16 m and high tide water depth is 21 m. Buoyancy impact on high tide torsion moment is 7% of increase in case of Embodiment 1, whereas 53% reduction in case of Embodiment 4. Although concrete wall cost may increase, a big cost merit dose not change (corresponding to previously mentioned "Problem 5: Increase of torsion moment").

EXPLANATION OF REFERENCE NUMERALS

5 Gate body (completely closed)
6 Gate body (completely opened)
7 Storage space
8 Center line of the tidal gate
9 Interval gate (completely closed)
10 Interval gate (completely opened)
11 Side roller block
12 Side roller guide
13 Watertight bulkhead
14 Cross-sectional restriction block
15 Bottom roller
16 Bottom roller mounting
17 Coupling wedge
18 Left balance tank
19 Right balance tank
19*a* Descending tank
20 Site water level
21 High tide level
22 Main roller
23 Bottom seal rubber (Bottom seal)
24 Side seal rubber
25 Support bracket
26 Reaction axle
27 Reaction roller
28 Rotation axle of reaction roller 27 and bottom seal rubber 23
29 Hub
30 Oil-less bearing
31 Axle mating part of reaction axle 26 where support bracket 25 mates
32 Rotation axle of side seal rubber 24

The invention claimed is:

1. A sluice gate comprising a gate body mounted in a direction vertical to a sluice connected to a sea, stored within a storage space on a bottom of said sluice when in an opened state, and rising from said storage space to move to a position vertical to said sluice when in a closed state, characterized in that said gate body has a torsion type structure characterized by a thin wall closed cross section and a cross sectional restriction wherein a vertical cross section of said gate body is restricted by a point, said gate body, when in said closed state, comprises a cross sectional restriction point wherein said thin wall closed cross section withstands high tide pressure, and a reaction roller contacting an inner face of said storage space to withstand tide flow pressure, and said reaction roller is an opening and closing operation type.

2. A sluice gate according to claim 1, characterized in that said gate body comprises a bottom seal contacting said inner face of said storage space, and said bottom seal is an opening and closing operation type.

3. A sluice gate according to claim 2, characterized in that according to the restriction conditions of said cross sectional restriction point, rotation is unrestricted but parallel shift is restricted, and said cross sectional restriction point is arranged on a sea side.

4. A sluice gate according to claim 2 or 3, characterized in that said gate body, when in said closed state, comprises a reaction axle engaging with a support bracket mounted on said storage space, wherein said support bracket and said reaction axle form said cross sectional restriction point during engagement, and said reaction axle comprises a plurality of hubs, each having an integrated bearing, and an axle mating part, mounted between said plurality of hubs and engaging with said support bracket, wherein a cross section of said axle mating part is the same shape as the inner face of said support bracket, thereby forming a bearing type connection.

* * * * *